US005108409A

United States Patent [19]

Demeester

[11] Patent Number: 5,108,409

[45] Date of Patent: Apr. 28, 1992

[54] DEPILATING APPARATUS

[76] Inventor: Jacques Demeester, 17 Via Maderno, Lugano, Switzerland

[21] Appl. No.: 506,338

[22] Filed: Apr. 9, 1990

[30] Foreign Application Priority Data

Apr. 21, 1989 [FR] France ..... 89 05324

[51] Int. Cl.[5] ..... A45D 26/00

[52] U.S. Cl. ..... 606/133; 606/131

[58] Field of Search ..... 606/36, 41, 43, 51, 606/52, 131, 133, 211

[56] References Cited

U.S. PATENT DOCUMENTS

| | | | |
|---|---|---|---|
| 1,315,829 | 9/1919 | Glaser et al. | 606/133 |
| 3,614,382 | 10/1971 | Politzer | 606/43 |
| 4,279,253 | 7/1981 | Haes et al. | 606/133 |
| 4,917,678 | 4/1990 | Locke et al. | 606/133 |

FOREIGN PATENT DOCUMENTS

| | | |
|---|---|---|
| 0147285 | 7/1985 | European Pat. Off. . |
| 0287976 | 10/1988 | European Pat. Off. . |
| 2395724 | 1/1979 | France . |
| 2588732 | 4/1987 | France . |
| 2586538 | 10/1987 | France . |
| 652899 | 12/1985 | Switzerland . |

*Primary Examiner*—Stephen C. Pellegrino
*Assistant Examiner*—Glenn K. Dawson
*Attorney, Agent, or Firm*—Young & Thompson

[57] ABSTRACT

A depilating apparatus has a depilator head (1) comprising a series of movable blades (7) arranged in pairs for forming a plurality of tweezers for gripping and pulling out the hairs to be eliminated. The depilator head is linked with a mechanical drive adapted for imparting thereto a translational movement, substantially along a plane (X-X') parallel to the plane defined by the free edges of the movable blades (7) forming the gripping tongs, and for further imparting thereto, during this translational movement, a movement of retraction away from this plane (X-X'), this latter movement taking place along an axis (Z-Z') perpendicular to this plane. There is further an actuator for driving the movable gripping blades (7) so as to effect the closing of the pinching tongs before the beginning of the retraction movement of the depilator head, and to cause these tongs to open and to remain open until they are closed again before the next retraction of the depilator head.

22 Claims, 6 Drawing Sheets

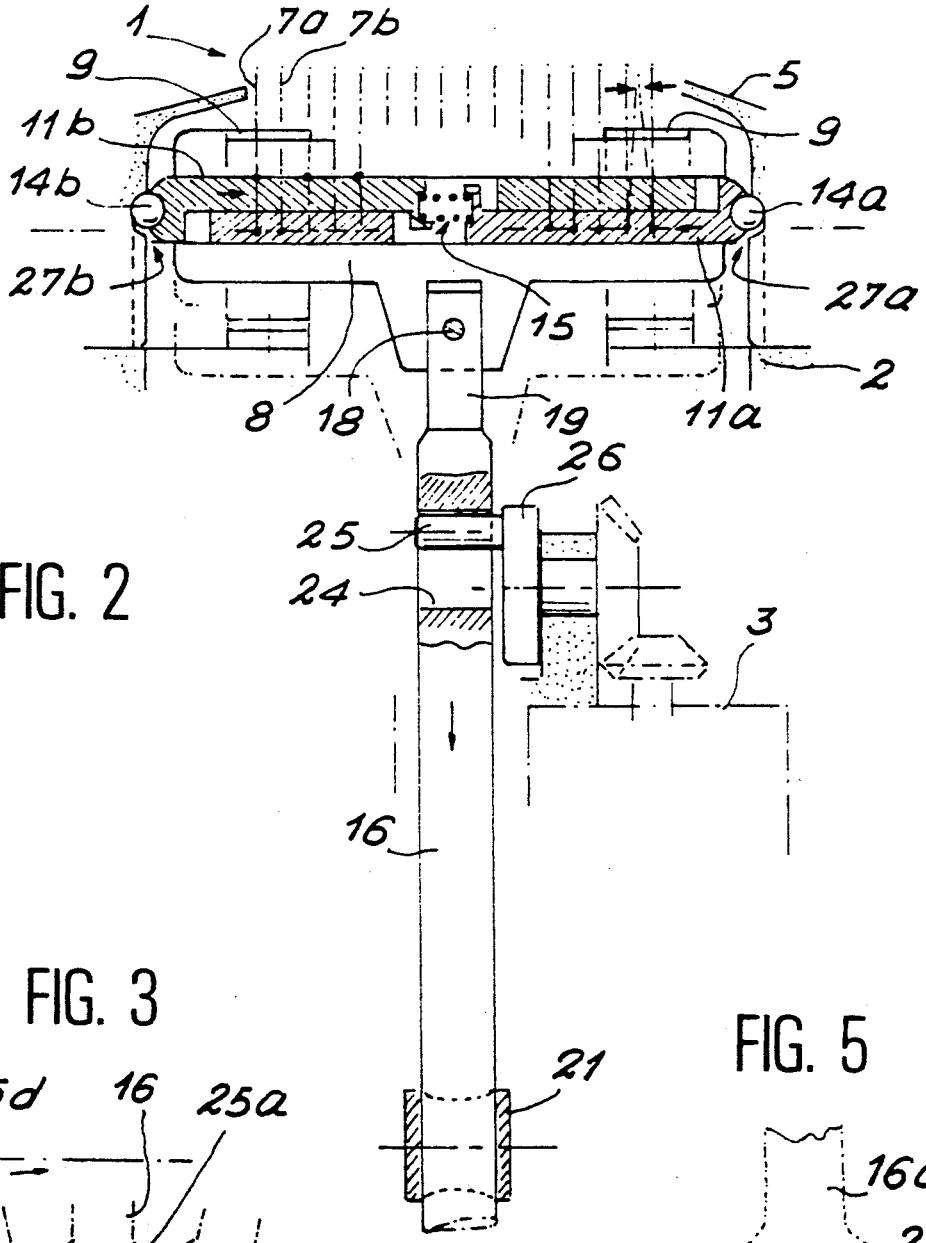
FIG. 2
FIG. 3
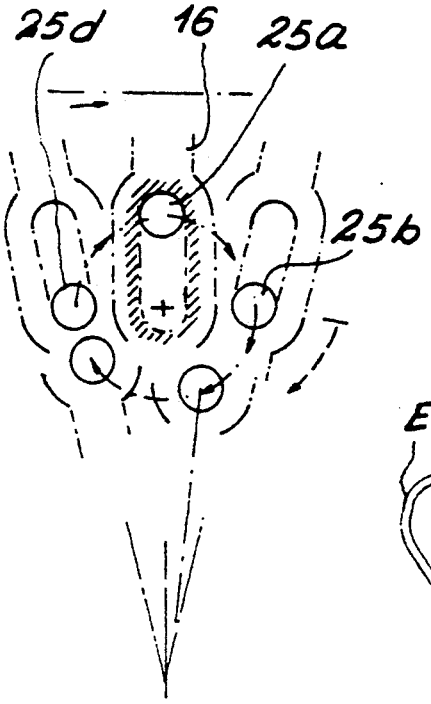
FIG. 5
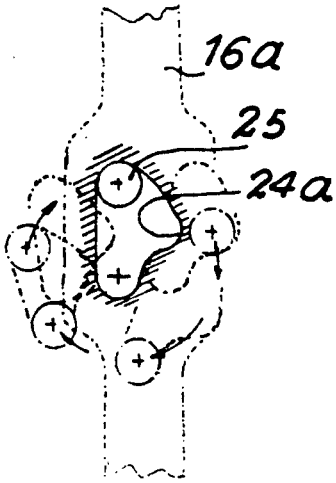
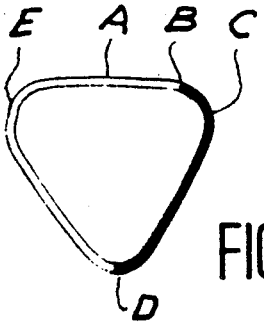
FIG. 4

FIG. 6
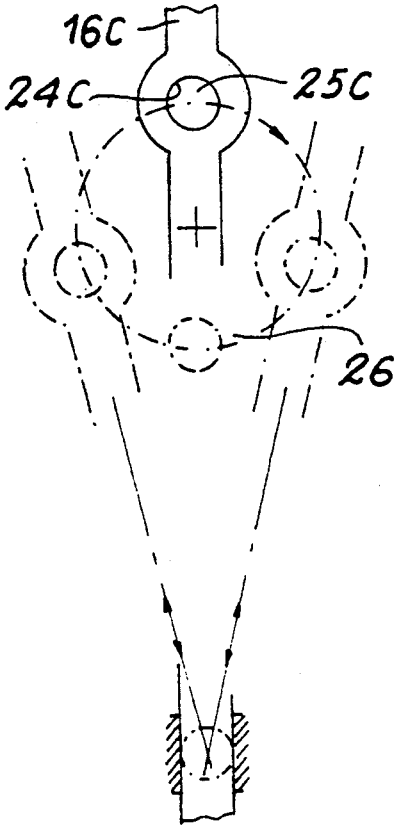
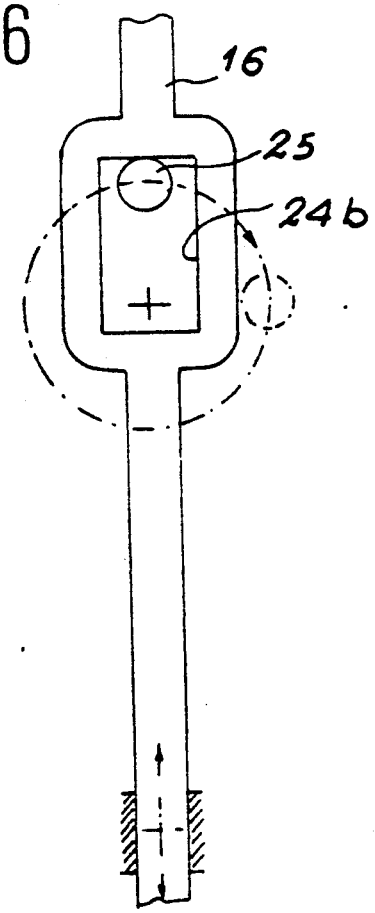
FIG. 7
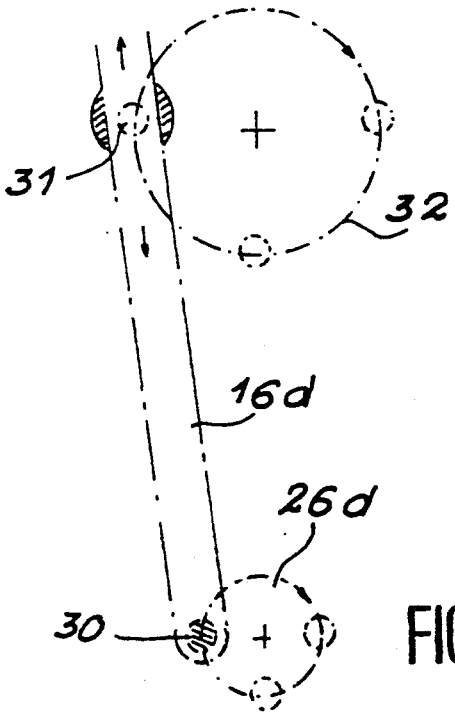
FIG. 8

FIG. 9
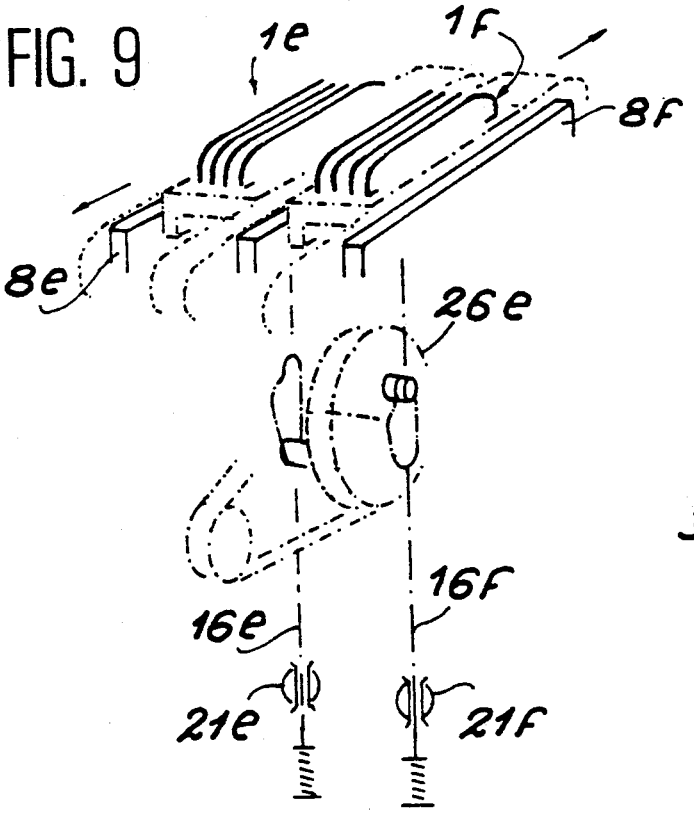
FIG. 10
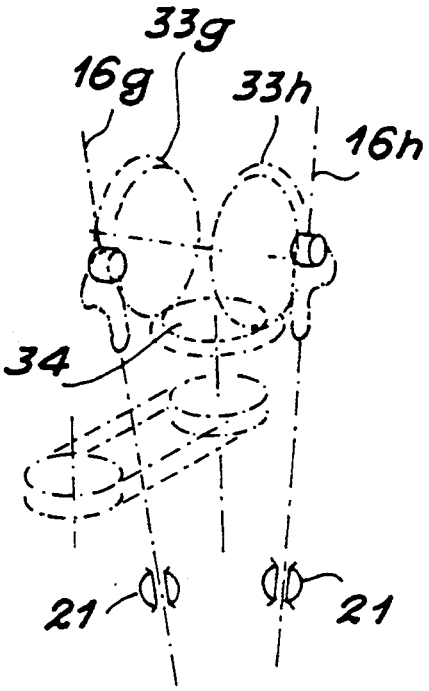
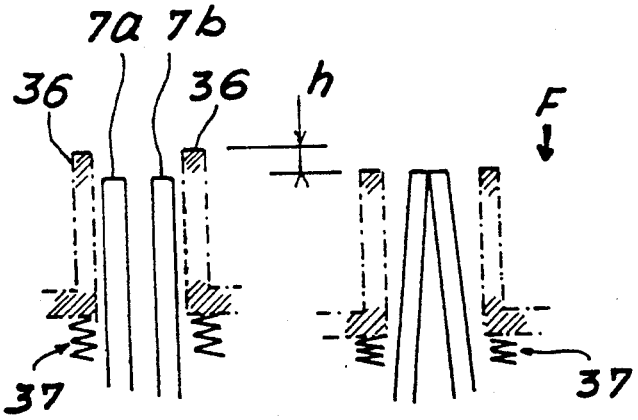
FIG. 12 FIG. 13
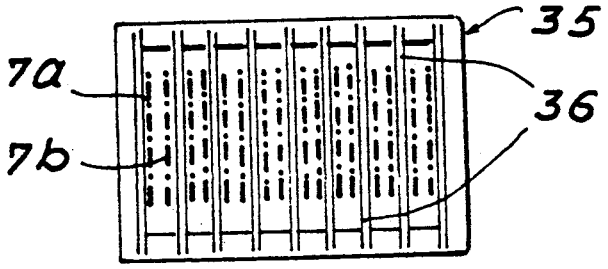
FIG. 11

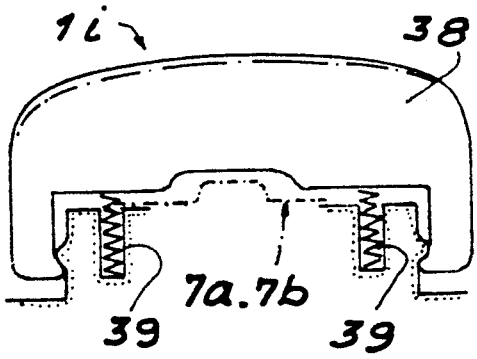
FIG. 14
FIG. 15
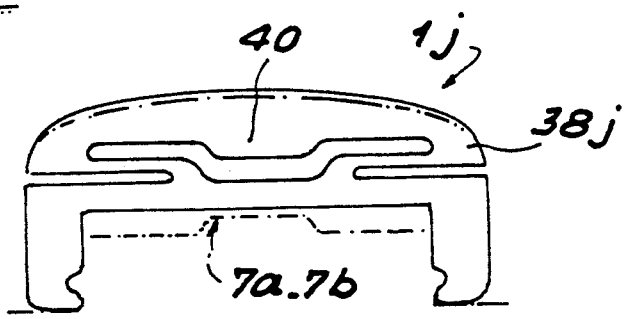
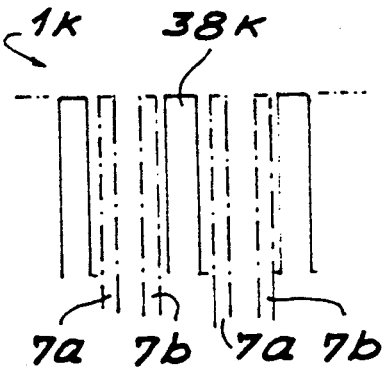
FIG. 16
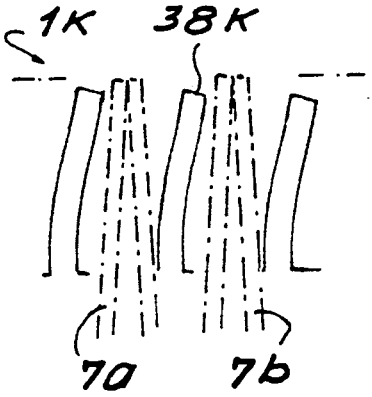
FIG. 17
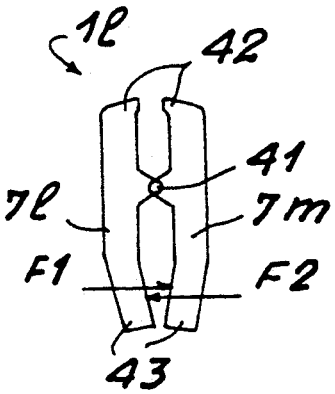
FIG. 18
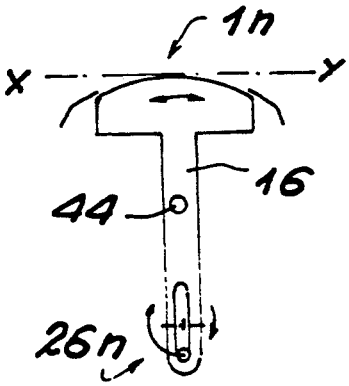
FIG. 19

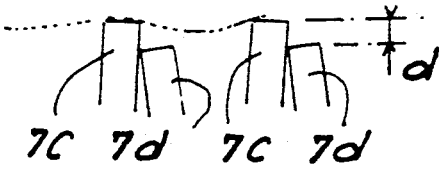
FIG. 21
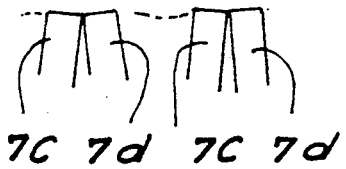
FIG. 22
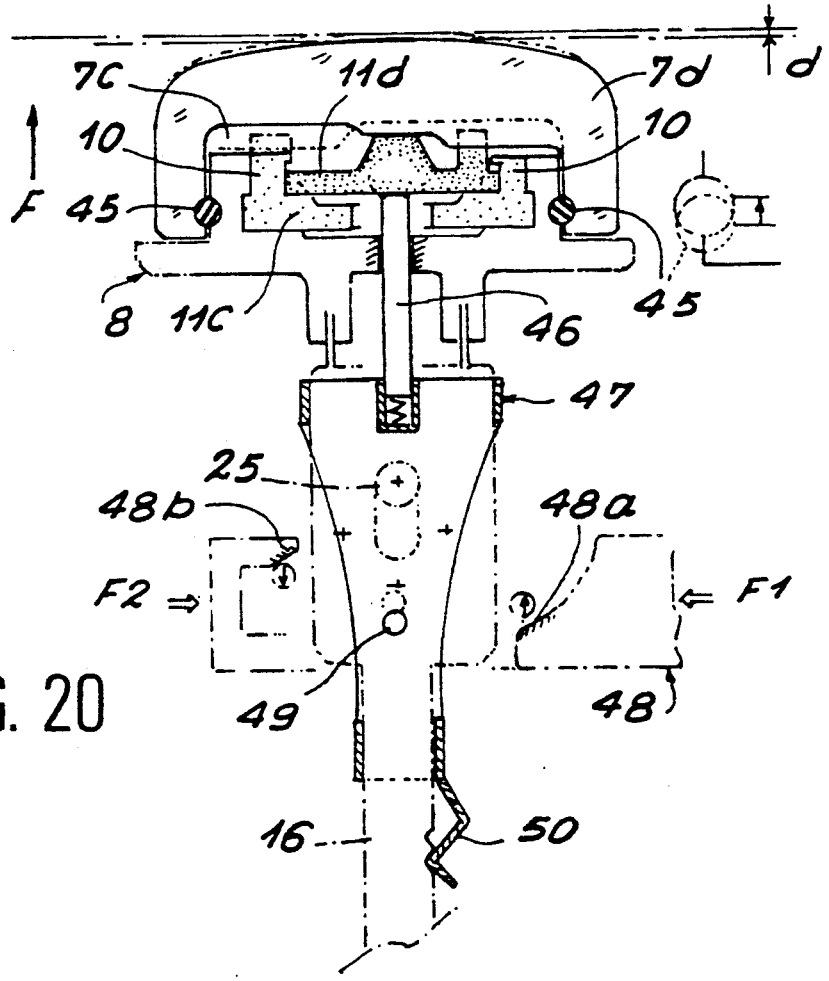
FIG. 20
FIG. 23
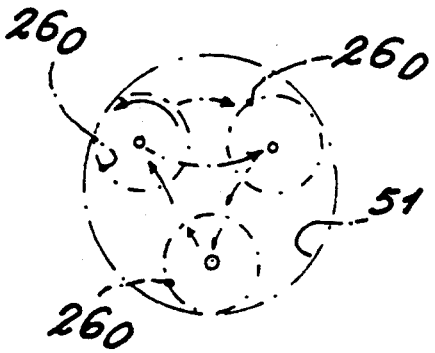
FIG. 24
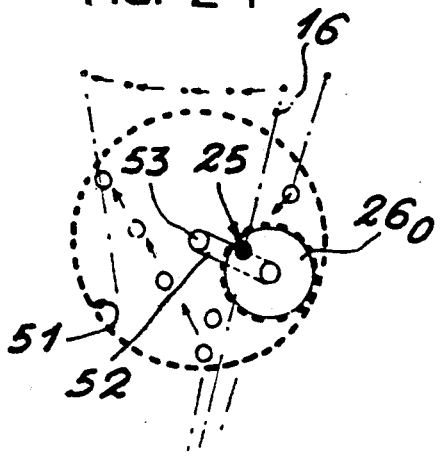

DEPILATING APPARATUS

This invention relates to small hand-held devices useful for removing unwanted hair.

FIELD OF THE INVENTION

This invention relates more particularly to a small hand-held depilating apparatus provided with at least one pair of mobile members adapted for gripping and pulling-out unwanted hair. More specifically, the apparatus of the invention is designed for being actuated by a small battery-operated electric motor incorporated in the apparatus.

BACKGROUND OF THE INVENTION

There already exists a certain number of devices of the above-mentioned kind, some of which correspond merely to adding a motor to hand-operated depilating tweezers. Thus, French Patent No. 2,395,724 describes a device of this kind. This device offers a satisfactory effectiveness in respect of its pulling-out action, since each hair being gripped is pulled out by a pulling movement which is exerted perpendicular to the skin. However, the usefulness of this device is extremely restricted. In fact, hairs do not readily become engaged between the gripping members, as they rather tend to be flattened down against the skin by the movement of the gripping members.

This is why other types of devices have been designed in such manner as to comprise mobile gripping and pulling members which describe a permanent sweeping and combing motion along the plane of the skin. This is the case of the device described in French Patent No. 2,586,538. However, with this apparatus the pulling action is exerted obliquely, instead of being perpendicular to the skin surface, as in the case of a hand-operated hair tweezer of a conventional type. As a result, devices of this kind are less effective, since they do not ensure that hairs will be effectively pulled out together with their root bulb as they are when the pulling-out motion is perpendicular to the skin. As a result, it frequently occurs that some hairs become broken at their base instead of being pulled out.

It is therefore an object of the present invention to provide a small depilating apparatus which is designed so as to be capable of pulling out a substantial number of hairs, while retaining the advantages of a pulling-out action which is perpendicular to the skin and will not tend to break the hairs at their base.

BRIEF DESCRIPTION OF THE INVENTION

The apparatus of this invention comprises a depilating head including a series of mobile blades forming a plurality of pairs of gripping tweezers which are alternatively opened and closed for pulling out the hairs which are to be removed. This apparatus is characterized in that its depilating head being mounted on one end of the housing of the apparatus is linked with drive means adapted for imparting to this head, simultaneously:

a first movement having periodically a main component which is parallel or substantially parallel to the working plane of the depilating head, and therefore to the skin surface, so as to facilitate, by means of a combing effect, the engagement of the hairs which are to be pulled out between the gripping blades;

a second movement, taking place during said first movement, which is a recoil of said head away from its working plane, along an axis which is perpendicular, or at least substantially perpendicular to said plane;

the actuating means for the mobile gripping blades being adapted for achieving the closing together of the corresponding tongs prior to the recoil of the depilating head, and then for opening said tongs until they become closed again before another recoil motion of the depilating head takes place.

Therefore, the design of this apparatus combines the advantages of a combing action on the hairs before they become gripped and then pulled in a direction substantially perpendicular to the skin surface. In fact, the initial movement of the mobile blades along a plane substantially parallel to the skin achieves a preliminary combing effect which helps the hairs to become engaged between the gripping blades, as a result of the orientation being thus imparted to the hairs. The effectiveness of the subsequent pulling-out action is due to the fact that the traction exerted on the hairs after they have been gripped between the blades takes place in a direction which is substantially perpendicular to the skin surface, but not sideways as it occurs in prior hair-removing devices.

According to a further feature of the invention, the mechanical drive means for driving the floating head of the apparatus are designed so that they will impart to said head a variable speed during its complex translatory and retracting movement, so that the speed of the floating head will drop to zero at the time of the closing together of the tongs, and will thereafter increase during the retracting motion of the head. This feature achieves a considerable increase of the effectiveness of the hair-removing apparatus of this invention.

In an advantageous embodiment of the new apparatus, the floating head which performs the hair-removing operation is linked with one end of a driver arm which is, in its resting position, substantially perpendicular to the plane defined by the free edges of the mobile blades, while a driving pin carried on a crank disk driven in rotation by the motor of the apparatus is coupled with said driver arm in an intermediary point along the length of said arm. This driving pin may then be engaged inside a slide provided in the driver arm and presenting a specific profile which determines the nature of the movement imparted to the driver arm.

Further features and advantages of the invention will appear from the following description, referring to the appended drawings shown by way of examples, in which:

FIG. 2 is a diagrammatic cross-section of the depilator head, taken along line II—II of FIG. 1;

FIG. 3 is a diagram illustrating the operation of the means actuating the driver arm of the depilator head;

FIG. 4 shows a curve illustrating the movements of the depilator head while the apparatus is being used;

FIG. 5 to 8 are diagrams similar to FIG. 3, corresponding to various modified embodiments of the invention;

FIG. 9 and 10 are schematic perspective views illustrating two further modified embodiments;

FIG. 11 is a diagrammatic plan view from above of one specific embodiment of the apparatus of this invention;

FIG. 12 and 13 are partial views, in vertical cross-section, of the depilator head, illustrating two different cases of utilization;

FIG. 14 and 15 are transversal cross-sectional views of two modified embodiments of the depilator head;

FIG. 16 and 17 are partial views in longitudinal cross-section of the depilator head provided in another modified embodiment, illustrating two different cases of utilization;

FIG. 18 is a diagrammatic view of yet a further embodiment of the depilator head in an apparatus according to the invention;

FIG. 19 is a diagrammatic elevation view of another further embodiment of the invention;

FIG. 20 is a partial view, in transversal cross-section, of another embodiment;

FIG. 21 and FIG. 22 are diagrams illustrating two different modes of operation of the pinching blades provided in this embodiment;

FIG. 23 and FIG. 24 are diagrams illustrating a particular embodiment of the means actuating the driver arm of the depilator head.

DETAILED DESCRIPTION OF THE DRAWINGS

Figure 1:
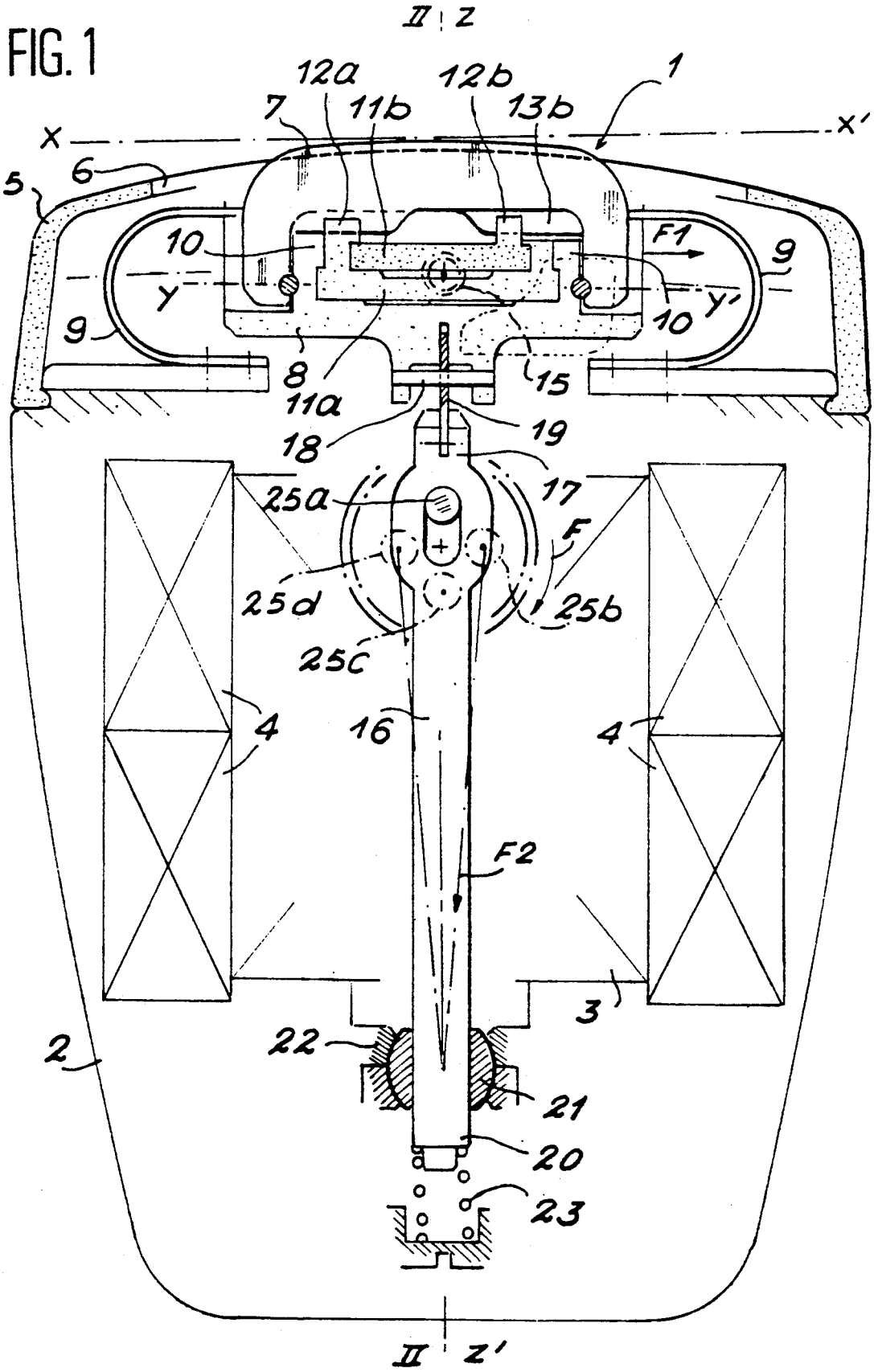
FIG. 1 is a transversal cross-section view of a depilating apparatus according to the invention.

Referring to FIGS. 1 to 3, these Figures show an apparatus comprising a depilator head designated generally by the reference number 1. This head is located in one end of a small housing 2 adapted for being hand-held. This housing contains a small electric motor 3 for driving the mechanical elements of the depilator head 1, with batteries 4 for energizing the motor 3.

The depilator head 1 is surrounded by a cap 5 engaged over the corresponding end of the housing 2 and comprising an opening 6 through which are slightly protruding the free edges of a series of blades 7 constituting the tweezers for gripping and pulling out the hairs which are to be eliminated. These blades 7 are disposed side-by-side and parallel together on a common support member 8. This support is mounted floatingly in the corresponding end of the housing 2, to which it is connected by arcuate leaf springs 9. The external edges of the gripping blades 7 extend substantially in one same plane X-X' corresponding to the working plane of the depilator head, this plane being intended for lying parallel to the skin and very close thereto. However, the free edges of the blades 7 may have a slightly arcuate profile which will be tangent to the plane X-X', in the manner shown in the example illustrated in FIG. 1.

Each of the blades 7 has the shape of an arch, the lateral arms of which are disposed alongside two projecting edges 10 carried by the mobile support 8. The mounting of the blades 7 on these edges 10 is such that the blades may swivel, at their base, about a series of parallel axes Y-Y'. Thus, through a swivelling movement of two adjacent blades 7 moving in opposite directions, these blades being respectively designated as 7*a* and 7*b*, the outer edges of the blades may be pressed against each other so as to form a gripping and pulling pair of tongs. For achieving this motion, the blades 7 are alternately coupled with two actuator strips, respectively 11*a* and 11*b*, which are adapted for causing the blades to swivel from side to side. These two strips 11*a* and 11*b* are disposed one over the other between the two projecting edges 10 of the mobile support 8. Each strip 11 comprises a small yoke, 12*a* and 12*b* inside which is engaged a projecting lug 13*a* or 13*b* of the corresponding blade 7*a* or 7*b*. The pinching surface of the blades 7 will then depend on the shape of the outer edge of these blades. This makes it possible to define a very effective pinching effect with a good regularity over a very small surface, without requiring a special precision of machining.

FIG. 2 shows how each of the actuator strips 11*a* and 11*b* projects beyond either end of the depilator head 1 and is provided on its end with a small roller 14*a*, 14*b* pressing against the corresponding internal walls of the cap 5. A coil spring 15 inserted between the two strips 11*a* and 11*b* as shown in FIG. 2 tends to spread apart these two strips so that the external edges of the blades 7*a*, 7*b* are similarly spread apart as shown in FIG. 2, which provides for the opening of the gripping tongs.

In the example shown, the means for driving the floating depilator head 1 include a driver arm 16. When at rest, this arm is substantially perpendicular to the X-X' plane defined by the free edges of the blades 7. The mobile support 8 carrying the blades 7 is linked to a corresponding end 17 of the driver arm 16. For this purpose, the support 8 is pivoted, by means of a pivot pin 18, on a lug 19 carried on said end 17 of the driver arm 16.

The opposite end 20 of the driver arm 16 is axially slidable inside a ball-and-socket unit 21, 22, the fixed socket 22 being provided in the housing 2. A compression coil spring 23 is provided between the bottom of the housing 2 and the end 20 of arm 16 so as to maintain this arm 16 and the floating depilator head 1 in a position where the outer edges of the blades 7 rest in plane X-X' or are tangent to this plane.

In an intermediary point of its length, the actuator arm 16 comprises a slide 24 inside which is engaged a driving pin 25 carried on a crank-disk 26 rotatably driven by the motor 3.

Owing to the design of the aforesaid drive means, the floating depilator head describes a dual movement, namely:

a) a translation movement along arrow $F_1$, approximately in a plane parallel with plane X-X', and along an axis which is parallel with the outer edges of the blades 7, and therefore parallel with the swivelling axes Y-Y' of these blades, and:

b) during this translation movement, a movement of retraction away from plane X-X', approximately along an axis Z-Z' perpendicular to plane X-X'.

In fact, the rotation of the crank-disk 26 in the direction of arrow F, starting from the rest position shown in FIG. 2, causes the driving pin 25 to move from position 25*a* to position 25*b*, thereby causing a translation of the depilator head 1 in the direction of arrow $F_1$. During this motion, the driving pin 25 slides inside the slide 24 so that the driver arm 16 simply carries out a swivelling movement permitted by the free rotation of the ball 21 in the socket 22, while the free edges of the blades 7 remain substantially in the X-X' plane.

However, when the driving pin 25 reaches its position 25*b*, it bears against the bottom end of the slide 24 and henceforth a further rotation of the crank-disk 26 will cause the driving pin 25 to drive along the actuator arm 16 in the direction of arrow $F_2$ until the pin 25 reaches a further position 25*c*. This will then cause a movement of retraction of the whole assembly forming the floating depilator head 1, this movement being substantially perpendicular to the X-X' plane.

After this, the driving pin 25 moves from its position 25*c* to position 25*d*, allowing the actuator arm 16 to return to its initial sliding position inside the ball 21. This will therefore bring back the free edges of the blades 7 into the plane X-X'.

Finally, when the driving pin 25 moves from its position 25*d'* to its initial position 25*a*, it will then simply move inside the slide 24 while imparting a swivelling movement to the actuator arm 16. This will therefore result in another movement of translation of the depilator head 1 along arrow $F_1$, and so on.

FIG. 4 shows a curve illustrating the various movements of the depilator head 1 during the utilization of the apparatus. In this curve, the portion indicated by two parallel lines represents the whole of the stroke during which the gripping tongs are open. The curve portion shown as a thick line represents the stroke during which the tongs are closed. The closing of the tongs begins at point B, slightly ahead of point C which indicates the beginning of the retraction of the gripping head, this closing action terminating at point D which corresponds to the end of this movement of retraction. The opening of the blades begins at point D for terminating at aforesaid point B. The EAC portion of the curve shown in FIG. 4 represents the movement of translation in parallel with the X-X' plane, with point A corresponding to the position shown in FIG. 1 and FIG. 2. The CD portion of the curve represents the movement of retraction of the depilator head. Finally, the DE portion represents the return of the depilator head towards the vicinity of the X-X' plane.

On another hand, there are provided drive means for acting upon the two actuator strips 11*a*, 11*b* which drive the blades 7 so as to cause them to swivel in opposite directions at the required time for closing and opening the gripping tongs constituted by these blades 7. In this embodiment, the inner walls of the cap 5 carry cams 27*a*, 27*b* adapted for acting on the respective ends of the strips 11*a*, 11*b*. The profile of these cams is designed so that the strips 11*a*, 11*b* will at first cause the gripping tongs to close together prior to the retraction movement imparted to the depilator head 1 and to maintain this closing throughout the retraction movement, and will next cause the tongs to open while the depilator head returns to its initial position, and will keep them opened until a short while before the beginning of the next movement of retraction of the depilator head.

As a result, the major part of the translation movement imparted to the blades 7 along a plane parallel to the X-X' plane takes place while the gripping tongs are open. This brings about a combing action on the hairs which are to be pulled out, thereby orienting them in parallel with the blades 7 and facilitating their engagement between the blades.

The pulling-out of the hairs is carried out by a traction exerted substantially perpendicular to the X-X' plane, and thus to the skin surface. This achieves an excellent removal of the hairs, together with their root-bulbs, avoiding the risk of breaking the hairs at their base, as it occurs with prior depilating devices.

FIG. 5 shows a modified embodiment of the drive means for the floating depilator head 1. In this embodiment, the shape of the slide 24*a* provided in the corresponding driver arm 16*a* is such that the driving speed of the depilator head is variable during the various phases of movement of this head. More specifically, the profile of this slide 24*a* is designed in such manner that the translation movement parallel to the X-X' plane becomes zero while the gripping tongs are closed, and before the retraction movement effecting the pulling-out of the hairs takes place. This provides for an improved efficiency of the pulling-out operation. Since the clamping down of the pinching blades takes place without any shock, as well as without any translational displacement of the blades, the hair is pinched gently, without any risk of breakage. In this respect, it will also be possible to provide any other suitable profile for the slide 24 in the driver arm for obtaining various rates of variation of the velocity of the different movements imparted to the depilator head.

FIG. 6 shows a further modification in which the slide 24*b* has a rectangular shape, the driving pin 25 carried by the rotating crank-disk 26 being engaged inside this slide. The shape of this slide brings about a sharper recoil movement of the depilator head, so that the pulling-out action will take place more exactly perpendicularly to the working plane of the depilator head. In fact, when the driving pin 25 reaches the upper end of the rectangular aperture 24*b*, it will then slide against the edge of this aperture, in a direction opposite to the depilator head.

Many other different profiles may be envisioned for the slide or aperture in which will engage the driving pin 25 carried by the crank-disk 26, taking into account the nature of the movement which is to be imparted to the depilator head.

FIG. 7 shows a simplified embodiment in which there is not provided a slide in the driver arm 16*c*, but merely a circular hole 24*c* is provided in this arm for receiving the driving pin 25*c* rotatably therein.

This arrangement is designed for imparting to the depilator head a movement along an elliptical path, thus insuring the same mode of operation as in the other embodiments, namely a movement taking place substantially along the working plane X-X' of the depilator head, and a movement of retraction away from this plane.

It should be noted that the movement of retraction can be effected at different stages of the translation movement parallel to the X-X' plane. In the above examples, this retraction takes place when the head reaches the end of its stroke towards the right side of FIG. 1. However, the drive means could be arranged so that the retraction will occur when the head is at mid-stroke in its translation parallel to the X-X' plane, or else at any other suitable position in this translation stroke.

More generally, the combination of a crank-disk carrying a pin which engages the driver arm for the depilator head might be replaced by any other mechanical system capable of achieving the same combination of movements, i.e. a translational movement substantially parallel to the X-X' plane and a recoil movement substantially perpendicular thereto.

FIG. 8 shows an example of such a modification, in which the depilator head 1 could be linked with one end of a driver arm 16*d*, the opposite end of which is pivotally linked with a pin 30 carried by a crank-disk 26*d* driven by the motor of the apparatus. The driver arm carries, in an intermediary point along its length, a stud 31 which is engaged inside a stationary circular guiding slide 32. With this arrangement, a fraction of the head movement takes place substantially along the X-X' plane, jointly with a recoil movement away from this plane. Once again, many other driving mechanisms could be used for obtaining the required movements of the depilator head.

One possibility would be to replace the driver arm 16 with two separate arms describing similar movements along the X-X' plane, but having opposite movements along the Y-Y' axis for causing the blades to close together by driving the respective strips 11*a*, 11*b* carrying these blades. The movement of the arms 16 along this axis Y-Y' would be created by a cinematic system linked to the rotation of the crank-disk in such manner as to periodically trigger the pinching movement of the blades, always at the same point of the path along the X-X' plane. The driver arms 16 may have various configurations, such as scissors, or a trapeze, with a rotation capable of creating the aforesaid movement. This specific design is advantageously suitable for a depilating apparatus having only a single pair of hair-pulling blades, so that the construction of the depilator head is simplified.

A further system can be envisioned, in which a compression spring is used for pinching the blades together, while the mechanical movement would cause the blades to spread apart, by compressing the spring. This system, in which the function of the mechanical movement is inverted, has this advantage that it requires a lesser precision. In fact, the pressure exerted by the spring depends only little on the dimensions or wear of the parts, which is not the case with the previous system.

Also, the means for driving the swivelling motion of the blades 7, forming the gripping tongs, could be replaced by any other means capable of playing the same role during the various movements of the floating depilator head. In this respect, it should be noted that, instead of having the blades 7 swivelling about their bases, they might also be integral with the two driving strips 11*a*, 11*b*. The opposite movements of these strips would then cause the blades to clamp together and to spread apart by means of a simple movement of translation.

Once again, many other embodiments may be envisioned.

For instance, the arrangement of the means for driving the depilator head 1 could be designed so as to impart to this head a very elongated elliptical path.

In another design, some of the blades in the depilator head could be stationary, while the other blades would be mobile so as to close against the stationary blades in the closing position of the tweezers formed by these blades. For instance, in each pair of blades, one could be fixed and the other movable. For example, all the 7*a* blades would be fixed, in which case the corresponding strip 11*a* would not serve as a drive means. However, it will be possible to envision many other combinations of fixed blades and movable blades.

On another hand, the nature of the movement of the movable blades could be different. Instead of being pivoted, as shown in the example of FIGS. 1–4, these blades could have a translation movement for closing the tweezers formed by these blades. However, this closing action could also be achieved by bending the working tips of these blades, or of at least every second blade.

These gripping blades, or at least some of them, could be provided on their edge with a lining or with lining elements made of a material capable of adhering to human hairs. Such lining elements can be provided for a further improvement of the combing action on the hairs by the apparatus, before they become gripped between the gripper blades. When intermediary protection blades are provided between the gripper blades, such as shown in the embodiments illustrated in FIGS. 14–17 which will be described subsequently, these protecting blades may also be provided, on their periphery, with a lining or with lining elements made of a material capable of adhering to human hairs.

FIG. 9 represents a further modified embodiment in which there are provided two separate depilator heads 1*e*, 1*f* which are designed and arranged in a manner similar to the embodiment shown in FIG. 1 and FIG. 2. The drive means for these two depilator heads will then be such as to impart movements of the same nature to these heads, these movements being however offset in the course of time so that they will be symmetrical. For this purpose, the drive means may comprise a rotary disk 26*e* carrying driving pins on both its faces, in two diametrically opposed locations, these pins engaging respectively two driver arms 16*e*, 16*f*. One end of these arms is linked to the respective support 8*e* or 8*f* of either depilator head, and the opposite driven end of these arms is slidable through the ball 21*e*, 21*f* of a ball-and-socket device. This arrangement has the advantage of avoiding jolts which are liable to occur when only a single depilator head is provided.

FIG. 10 illustrates a further embodiment in which are again provided two separate depilator heads (not shown), this embodiment being however designed so that the heads follow movements of the same kind, but in inverted directions. For this purpose, the driver arms 16*g*, 16*h* for these two heads are pivotably linked, in an intermediary point along their length, with two rotating disks 33*g*, 33*h* which are driven in opposite directions by a bevel gear 34. In the same way as in the previous embodiments, the ends of the two driver arms being opposite to the depilator heads are slidable inside ball-and-socket devices 21. This arrangement also has the advantage of avoiding jolts, as may be liable to occur with a single depilator head.

FIGS. 11–13 illustrate a particular embodiment in which a protection grid, generally designated as 35, is associated to the depilator head. The cross-members 36 of this grid are disposed between two successive pairs of gripper blades 7*a*, 7*b*, in the manner shown in FIG. 11. This grid 35 rests against springs 37 which tend to push it outwardly so that the edges of the cross-members 36 will be protruding by a distance h beyond the free edges of the gripper blades 7*a*, 7*b* (see FIG. 12).

In this situation, when the grid 35 is pressed against the skin, only its cross-members 36 are contacting the skin, since the edges of the blades 7*a*, 7*b* are recessed. But, upon the apparatus being pushed more strongly against the skin, this causes the grid 35 to retract in the direction of arrow F against the force of the springs 37 until the edges of blades 7*a*, 7*b* come into contact with the skin, as shown in FIG. 13. From then on, the blades are capable of pinching between them the hairs which have to be pulled out. But as soon as the user releases the pression on the apparatus, the protection grid is again pushed outwardly by the springs 37, thus neutralizing the action of the gripper blades 7*a*, 7*b*.

As a result, the user is enabled to adjust the action of the apparatus by pressing it more or less strongly against the skin. At first, the user may simply bring the device in contact with the skin, so that the blades will have no action. The user may then press the device more strongly, for causing the blades to become active. However, as soon as the pulling-out action appears painful, it will suffice for the user to release the pressure exerted on the apparatus for stopping the action of the gripper blades.

In this situation, the apparatus of this embodiment is better adapted for depilating specific areas of the skin which are particularly sensitive.

For the same purpose, it is also possible to provide, instead of the grid 35, a movable frame which merely surrounds the pinching blades 7*a*, 7*b*, this frame being movable against springs 37, in the same way as the grid 35. It would also be possible to envision a frame carrying a comb-like structure projecting from the inner edge of the two longer sides of this frame.

FIG. 14 illustrates another embodiment which is also designed for achieving a gradual action of the apparatus. In this embodiment, the depilator head 1*i* comprises a series of protection blades 38, each one arranged between two successive pairs of pinching blades 7*a*, 7*b*, and having the same orientation. However, these protection blades 38 are biased by springs 39 tending to maintain them normally in an extended position in which their free edge projects beyond the free edge of the pinching blades 7*a*, 7*b*, in rather similar manner as the cross-members 36 of the protection grid 35 in the embodiment shown in FIGS. 11–13.

Thus, when the user places the depilator head 1*i* against the skin, solely the protection blades 38 are contacting the skin, while the pinching blades 7*a*, 7*b* are recessed, so that their action is somehow neutralized. But it will be sufficient for the user to press the apparatus against the skin for causing a receding movement of the protection blades 38 and for gradually bringing the pinching blades 7*a*, 7*b* into action.

FIG. 15 illustrates another embodiment which corresponds to the same general design. The only difference lies in the fact that the spring-mounted protection blades 38 of the previous embodiment are replaced by protection blades 38*j* provided with cut-out indentations 40 having a particular shape which allows the protection blades to contract and therefore to recede when the depilator head 1*j* is pressed against the skin. The mode of operation is therefore the same as in the previous embodiment.

FIGS. 16 and 17 illustrate yet a further embodiment which is also designed for a gradual action of the apparatus.

In this embodiment, the protection blades 38*j* of the example shown in FIG. 15 are replaced by protection blades 38*k* which will flex when the corresponding depilator head 1*k* is pressed against the skin (see FIG. 17). For this purpose, these protection blades 38*k* are made of a material capable of flexing resiliently when the apparatus is pressed against the skin. The height of these blades is such that their free ends will normally project beyond the free edge of the pinching blades 7*a*, 7*b*, as shown in FIG. 16. As a result, when the depilator head 1*k* is applied against the skin, the blades 7*a*, 7*b* will remain ineffective as long as the user does not actually press the apparatus against the skin.

FIG. 18 illustrates another embodiment in which the depilator head 11 comprises only two pinching blades 7*l* and 7*m*. These two blades are pivotally linked together in an intermediary point along their length, about a pivot pin 41, so that their working ends 42 may be pressed against each other in the closing position of the tweezer being formed in this manner. However, the means for actuating these two blades are arranged so as to act on the opposite ends 43 thereof, as shown by arrows $F_1$ and $F_2$. This specific arrangement of the actuator means has the advantage of providing more free space around the working end of the apparatus. As a result, this working end may present a rod-like shape with a small cross-section, which is carried by the housing of the apparatus. This will allow the apparatus to be used for some apecific applications, such as for plucking eyebrows.

FIG. 19 represents yet a further embodiment which is distinguished from the previous ones by the nature of the driving means for the depilator head 1*n*. In this embodiment, the driving means comprise an actuator arm 16*n* pivotable, at an intermediary point along its length, about a fixed pivot pin 44, while its end opposed to the head is pivotally linked with a driving pin 25*n* of a rotary driving crank-disk 26*n*. The arrangement is such that the depilator head 1*n* will then follow a path comprising, in succession, a first arcuate portion tangent to the working surface X-Y of the apparatus, and then a second portion extending away from said surface before returning in the vicinity thereof.

In the embodiments shown in FIGS. 14–17, it is possible to replace the additional blades provided for protecting the skin by some other appropriate protection members such as some semi-stiff projecting rods or fingers, or else by elements being similar to semi-stiff bristles or the like.

Also, again in the embodiments of FIGS. 14–17, at least some of the additional blades (38, 38*j*) for protecting the skin may take part in the process of pinching the hairs which are to be pulled out.

On another hand, it is possible to envision a solution which is the reverse of the one shown in FIGS. 14–17, for achieving the same result, namely a delayed and smooth start of the pinching action of the gripper blades. In such a case, the protection blades would not be retractable, but the pinching blades would be movably mounted, so that they may be extended into a projecting position beyond the edges of the protection blades, actuator means being provided for controlling the displacement of the pinching blades into this extended position for bringing them into their operative state.

FIGS. 20–22 represent yet another embodiment which is also designed for permitting a postponed bringing into action of the pinching blades. In this embodiment, the mounting of the two matching series of pinching blades 7*c* and 7*d* is different from the mounting provided in FIGS. 1–3 inasmuch as the blades 7*d* of one of the two series may be placed in a slightly retracted position, with respect to the blades 7*c* of the other series, by a distance d (see FIG. 21), or may, on the contrary, be in alignement therewith. In the first case, the pincers formed by these two series are inactive, whereas in the latter case they are active.

For permitting this displacement of the blades 7*d*, the pivotal axes 45 of these blades on the edges 10 of the support 8 are made of a resilient material. On another hand, the actuator strip 11*d* of these blades 7*d* is loosely adjusted for allowing it to move to some extent along arrow F with respect to the strip 11*c* which actuates the blades 7*c*, and there is provided a pusher rod 46 by means of which the actuator strip 11*d* can be displaced along arrow F. This pusher rod is carried by a sleeve-like member 47 slidably mounted on the driver arm 16 of the depilator head. The displacement of this sleeve 47 in either direction may be controlled by means of a transversal sliding member 48 which may be actuated manually, this sliding member carrying two cams 48*a*, 48*b* which are capable of acting in opposite directions on a finger 49 carried by the sleeve 47. An angled leaf spring 50 is provided for immobilizing the sleeve 47 in each one of its positions of utilization.

Initially, the sleeve 47 is in the position shown in FIG. 20 wherein the blades *7d* are slightly retracted, with respect to the blades *7c*. In this situation, only the blades *7c* will contact the skin when the depilator head is placed against the skin. As a result, the depilator pincers formed by the two series of blades will then be inactive. But it will suffice to cause the sliding member 48 to slide in the direction of arrow $F_1$ for bringing the blades *7d* into their normal position, so that the depilator pincers go into action.

FIGS. 23 and 24 illustrate a particular modification of the means for actuating the driver arm 16 of the depilator head of the present apparatus. In this modified embodiment, the crank-disk carrying the driving pin 25 for driving said arm 16 consists in a pinion 26*o* meshing with the internal teeth of a fixed crown 51. This pinion is driven by a crank-pin 52 rotating about a central axis 53 (see FIG. 24). The pinion 26*o* and the fixed crown 51 are thus forming a hypocycloidal mechanism which imparts to the driving pin 25 a path of a very particular shape, illustrated in FIG. 23 and 24, which also determines a very particular movement of the depilator head of the corresponding apparatus.

What is claimed is:

1. A depilating apparatus comprising a depilator head including movable blades forming together at least one pair of gripping blades which are alternately opened and closed for pulling out hairs which are to be eliminated, wherein said depilator head (1) is mounted on one end of a housing (2) of said apparatus and is coupled with actuating means in said housing adapted for imparting to said head:

a first movement having periodically a main component which is substantially parallel to a working plane (X-X') of said depilator head and hence to a skin surface, and is also parallel to edges of the gripping blades (7) so as to facilitate, by means of a combing action, the engagement of the hairs which are to be pulled out between the gripping blades (7);

a second movement, which is a recoil, wherein said depilator head moves away from said working plane (X-X'), along an axis (Z-Z') which is substantially perpendicular to said working plane (X-X'), while the gripping blades (7) remain oriented in a same direction with their edges oriented towards the working plane;

said actuating means alternately causing the closing of the blades prior to the recoil of the depilator head (1) and then the opening of said blades until they become closed again before another recoil movement of the depilator head takes place.

2. A depilating apparatus according to claim 1, wherein the depilator head (1) is mounted as a floating unit on said one end of the housing (2).

3. A depilating apparatus according to claim 1, wherein said actuating means imparts to said depilator head a combined movement including a translation movement parallel to the working plane (X-X') of said head and a recoil movement away from said plane.

4. A depilating apparatus according to claim 3, wherein said actuating means imparts to said depilator head a variable speed during its combined movement, in such manner that the movement taking place substantially along the working plane (X-X') of said head becomes annulled while the blades are closed and before the start of the recoil movement which effects the pulling-out of the hairs to be eliminated.

5. A depilating apparatus according to claim 1, wherein the depilator head (1) is coupled with one end of a driving arm (16, 16*a*) which comprises in an intermediary point of its length a slide (24, 24*a*, 24*b*) inside which is engaged a driving pin (25) carried by a crank-disk (26) rotatably driven by a motor of the apparatus.

6. A depilating apparatus according to claim 1, wherein the depilator head (1) is coupled with one end of a driving arm (16*c*) pivotally linked, in an intermediary point along its length, with a driving pin (25*c*) carried by a crank-disk (26) rotatably driven by a motor of the apparatus.

7. A depilating apparatus according to claim 1, wherein an end (20) of a driving arm (16) that drives the blades, opposite to the depilator head (1) is mounted for sliding axially through a ball (21) of a ball-and-socket device with a fixed socket (22) mounted in said housing.

8. A depilating apparatus according to claim 1, wherein the depilator head comprises only two blades, each one of which is coupled with a driving arm adapted for imparting thereto at the same time a movement substantially parallel to said working plane and a movement of recoil away from said plane.

9. A depilating apparatus according to claim 1, wherein said actuating means is adapted for imparting to the depilator head a movement along a path having a very flat elliptical shape.

10. A depilating apparatus according to claim 1, wherein there are provided two said depilator heads (1*e*, 1*f*) in said housing with mechanical means adapted for imparting thereto the same movements but with an offset timing, so as to cause these movements to be mutually symmetrical.

11. A depilating apparatus according to claim 1, comprising two said depilator heads in said housing with mechanical drive means adapted for imparting thereto the same movements but in opposite directions relative to each other.

12. A depilating apparatus according to claim 1, wherein the depilator head is surrounded by a frame (35) serving as a supporting element against the skin, said frame (35) being resiliently mounted in said housing (2) so as to be mobile in a direction perpendicular to the working plane, resilient means (37) for tending to maintain this frame in a position wherein said frame projects slightly beyond the movable blades (7*a*, 7*b*) of the depilator head, so that by pressing this frame (35) against the skin said frame can be pushed back into a retracted position wherein said frame lies substantially along the same plane as said edges of said blades (7*a*, 7*b*).

13. A depilator apparatus according to claim 1, wherein there is a plurality of said depilator heads in said housing and each depilator head comprises a protection grid (35) serving as a supporting element against the skin, said grid comprising cross-members (36), each of which is arranged between two gripping blades (7*a*, adjacent pairs of same pinching pair, said grid (35) being mounted on said housing so as to be movable along a direction perpendicular to said working plane, against resilient means (37) tending to maintain said grid in a position projecting slightly beyond the gripping blades (7*a*, 7*b*) of the depilator heads, so that by pressing this grid against the skin said grid can be pushed back into a retracted position lying substantially in the same plane as said edges of said blades (7*a*, 7*b*).

14. A depilating apparatus according to claim 1, wherein the depilator head comprises semi-stiff fingers for protecting the skin or additional blades (38) for protecting the skin, which are normally slightly projecting beyond the edges of the gripping blades (7a, 7b) but are adapted for being retracted relative to said gripping blades when said fingers or additional blades (38) are pressed against the skin.

15. A depilating apparatus according to claim 14, wherein at least some additional skin-protecting blades (38, 38j) take part in the pinching action on the hairs having to be pulled out.

16. A depilating apparatus according to claim 1, wherein the depilator head comprises semi-stiff fingers for protecting the skin or additional blades (38j) for protecting the skin, which are normally slightly projecting beyond the gripping blades (7a, 7b) but are adapted for flexing resiliently rearwardly of said gripping blades when being pressed against the skin.

17. A depilating apparatus according to claim 1, wherein some of the gripping blades (7a, 7b) in the depilator head are fixed, other said blades being movable and adapted for being pressed, in the closing position, against adjacent fixed blades.

18. A depilating apparatus according to claim 1, wherein the depilator head (11) comprises only two pinching blades (7l, 7m) which are pivotally linked together at an intermediate point (41) along their length, the means for actuating said blades acting on the ends (43) of said blades lying opposite to the working plane.

19. A depilating apparatus according to claim 1, comprising also fixed protection blades (38) disposed between adjacent pairs of said gripping blades (7a, 7b) wherein at least some of the gripping blades (7a, 7b) and/or some of said fixed protection blades (38) are provided on their periphery with lining means made of a material capable of adhering to human hairs.

20. A depilating apparatus according to claim 1, wherein the depilator head is attached to one end of a driver arm (16n), the opposite end of which is pivotally linked to a rotatable crank-disk (26n), the arrangement being such that the depilator head (1n) follows a continuous path comprising a first arcuate portion tangent to said working plane and then a second portion extending away from said plane before returning into close vicinity thereto.

21. A depilating apparatus according to claim 1, wherein the depilator head comprises additional skin-protecting blades which are normally slightly projecting beyond the gripping blades (7a, 7b), said gripping blades being movable into an extended position projecting beyond said protection blades, actuating means being provided for controlling movement of the gripping blades (7a, 7b) into said extended position for bringing the gripping blades into operation.

22. A depilating apparatus according to claim 1, wherein one of two series of pinching blades (7d) is initially recessed relatively to the blades (7c) of the other series, and mechanical control means to subsequently being the last-named blades (7c) into alignment with the first-named blades (7d) for putting into action the depilating pincers constituted by these blades.

* * * * *